US005150598A

United States Patent [19]

Uchida et al.

[11] Patent Number: 5,150,598

[45] Date of Patent: Sep. 29, 1992

[54] APPARATUS FOR SCRIBING GRAIN-ORIENTED ELECTRICAL STEEL STRIP

[75] Inventors: Takayuki Uchida; Satoshi Ide; Masahiro Yamamoto; Atsushi Yumoto, all of Kitakyushu, Japan

[73] Assignees: Nippon Steel Corp., Tokyo; Nittetsu Plant Designing Corp., Kitakyushu, both of Japan

[21] Appl. No.: 750,759

[22] Filed: Aug. 22, 1991

Related U.S. Application Data

[63] Continuation-in-part of Ser. No. 480,824, Feb. 16, 1990, abandoned.

[30] Foreign Application Priority Data

Feb. 20, 1989 [JP] Japan ..... 1-38424

[51] Int. Cl.[5] ..... B21D 28/10; B21D 28/20; B21D 28/18

[52] U.S. Cl. ..... 72/325; 72/404; 72/453.13; 267/119; 100/259; 83/879

[58] Field of Search ..... 72/325, 404, 432, 453.13, 72/453.01; 267/119, 113; 100/259; 82/879

[56] References Cited

U.S. PATENT DOCUMENTS

| | | | |
|---|---|---|---|
| 1,691,667 | 11/1928 | Nilson | 267/119 |
| 1,773,438 | 8/1930 | Rode | 267/119 |
| 2,242,209 | 5/1941 | Dinzl | 72/453.13 |
| 3,426,571 | 2/1969 | Hoffman | 72/456 |
| 3,728,980 | 4/1973 | Fraze | 83/879 |
| 4,203,784 | 5/1980 | Kuroki et al. | 148/111 |

FOREIGN PATENT DOCUMENTS

| | | | |
|---|---|---|---|
| 0270762 | 5/1988 | European Pat. Off. . | |
| 2005943 | 8/1971 | Fed. Rep. of Germany . | |
| 2903929 | 8/1980 | Fed. Rep. of Germany . | |
| 53-137016 | 11/1978 | Japan . | |
| 60-96719 | 5/1985 | Japan . | |
| 57927 | 3/1989 | Japan | 72/453.13 |
| 846044 | 7/1981 | U.S.S.R. | 72/453.13 |

OTHER PUBLICATIONS

Sperry Vickers Industrial Hydraulics Manual, First Edition, Sep., 1970, Sperry Rand Corp., Troy, Michigan, pp. 12–13.

"Patent Abstracts of Japan" vol. 14, No. 77 (C-688) (4020), Feb. 14, 1990; Japanese Application No. 63-123875 (Nippon Steel).

"Patent Abstracts of Japan" vol. 9. No. 237 (C-305) (1960) JP-A-60-96719 (Kawasaki Seitetsu).

*Primary Examiner*—Daniel C. Crane

*Attorney, Agent, or Firm*—Kenyon & Kenyon

[57] ABSTRACT

An apparatus for scribing grain-oriented electrical steel strip has a movable die attached to a reciprocating drive and an opposite fixed die. A strip held between the two dies is scribed by the action of the movable die that is moved back and forth by the reciprocating drive. The fixed die positioned with the stroke of the movable die is supported by a plurality of cylinders connected to an accumulator whose pressure is preset to a level of the deformation resistance corresponding to the amount of deflection that varies with the depth of the impressions scribed on the strip.

10 Claims, 5 Drawing Sheets

APPARATUS FOR SCRIBING GRAIN-ORIENTED ELECTRICAL STEEL STRIP

This application is a continuation-in-part of application Ser. No. 07/480,824, filed Feb. 16, 1990, now abandoned.

BACKGROUND OF THE INVENTION

1. Field of the Invention

This invention relates to apparatus for scribing grain-oriented electrical steel strip, and more particularly to apparatus for scribing grain-oriented electrical steel strip that improves the core loss thereof by forming linear impressions on the surface thereof using oppositely disposed metal dies.

2. Description of the Prior Art

One of the practices that has come to be adopted recently in the manufacturing of grain-oriented electrical steel strip is to form linear impressions on the surface thereof. The object of this practice is to reduce the domain size by forming linear impressions, thereby improving core loss and magnetic properties.

But this practice calls for a high degree of mass producibility and extra-high precision working. For example, approximately 1000 impressions must be worked in a minute. The depth of scribing ranges from tens of μm to under 10 μm, sometimes with such a close tolerance as ± a few μm. Because these requirements are hard to fulfill with common scribing apparatus, the use of high-speed precision presses has been proposed recently.

The high-speed precision presses are equipped with an automatic control mechanism that detects the bottom dead center of the press stroke in operation and compensate for any change therein, the mechanism comprises means to change the die height by means of an AC servo motor or other type of actuator provided to a connecting rod. More specifically, the control mechanism consists essentially of a bottom dead center sensor (an eddy-current gap sensor) 52, an angle sensor 44, a servo motor 48 to correct the slide position, and a microcomputer 46 as shown in FIG. 11.

The mechanism shown in FIG. 11 operates as described below. The rotating energy supplied from a main motor 41 and stored at a flywheel 42 is converted into the vertical reciprocating motion of a slide 50 through a crankshaft 43 and a connecting rod 49. A top metal die 51 attached to the lower end of the slide and a bottom metal die 53 to the top of a bolster 54. The microcomputer 46 makes necessary calculation on the basis of a signal 55 that represents the displacement detected by the bottom dead center sensor (an eddy-current gap sensor) 52 and a signal 45 representing the angle of a crank 43 determined by the angle sensor 44. A resulting signal 47 representing the corrected displacement of the die height is sent to the servo motor 48 to correct the position of the slide 50. This type of mechanism can now work with a speed of 1,200 strokes per minute, with an allowable depth tolerance of ± 5 μm (as disclosed in Japanese Patent Publication No. 5968 of 1983 and Japanese Provisional Patent Publication No. 96719 of 1985).

High-speed precision presses of the type just described are very expensive because they need position sensors, controls and other feedback mechanisms to obtain the desired accuracy. Furthermore, they cannot cope with the variables due to the crown and other factors induced by the strip to be worked, because the object of their bottom dead center control is to make up for the thermal displacement of the press and the inertia force and initial backlash of the reciprocating segments.

Strip crown results when the axial deflection in the rolling rools is transcribed onto the strip being rolled. With a 1000 mm wide strip, thickness is generally smaller in a 400 mm wide central area by not greater than 1 μm and in edges by between 4 to 8 μm. Thus, strip crown is trapezoidal in cross section. Hydraulic presses may seen to offer solution for the problems associated with the profile change of the strip. Actually, however, they are difficult to use because of speed limitations and the need to make their size large enough to hold the required hydraulic liquid.

Hydraulic presses are capable of implementing control by transforming, in advance, a deflection matched to the deformation resistance of the strip into a force known as deformation resistance. Therefore, a hydraulic press can follow strip crown or other profile changes by adjusting the load distribution on its fixed receiving die. For example, load distribution may be controlled so that the bottom die follows the crown in the strip. But ordinary change-over and other valves used in the hydraulic circuit to control the load on the movable top die that determines the depth of scribing are incapable of quick response because they commonly operate with a time lag of 0.2 to 0.3 s. Some special-purpose servo valves have as short a response time as 0.02 second. In a pressing cycle, however, the top die coming in contact with the workpiece will reach the bottom dead center in a much shorter time. Assume that a press working with a speed of 600 strokes per minute and a stroke of 15 mm scribes to a depth of 0.1 mm. Then, the top die of this press reaches the bottom dead center in only 0.0026 second after coming in contact with the workpiece. Therefore, even quick responding servo valves are useless. The uselessness becomes more pronounced when the scribing depth is smaller and the operating speed is faster. They may be used if the scribing depth is greater and the operating speed is slower. For example, the time to reach the bottom dead center after coming in contact with the workpiece will be 0.083 second when the scribing depth is 1 mm and the operating speed is 60 strokes per second. But the equipment must be large enough to hold large quantity of hydraulic liquid need to obtain a stroke of tens of millimeters. In addition, it is difficult to carry out high-precision scribing at high speed while following changes in the profile of the workpiece.

SUMMARY OF THE INVENTION

The object of this invention is to provide simpler mechanism to scribe grain-oriented electrical steel strip with high accuracy and speed.

An apparatus for scribing grain-oriented electrical steel strip of this invention comprises a movable die attached to a reciprocating member and a fixed die that are disposed opposite to each other, the movable die moved by the reciprocating member scribing the strip positioned between the two dies. The feature of this invention is that the fixed die positioned within the limit of the stroke of the movable die is supported by a plurality of cylinder units connected to an accumulator whose pressure is preset at the level of the reaction force resulting from the deformation resistance corresponding to the amount of deflection that is determined by the depth of scribing on the strip.

A buffer may be provided in the movable die reciprocating member, with the reaction force of the buffer set at the level of the deformation resistance proportional to the deflection that occurs between the time at which the scribing tool attached to the movable die comes in contact with the strip and the time at which the tool reaches the bottom dead center. The fixed die may be divided into several segments either across or along the width of the strip, with the individual segments individually supported by respective cylinder units connected to accumulators whose pressures are maintained at the same level.

Dispensing with the servo valve and position sensor, the strip scribing apparatus according to this invention is simple. The strip scribing apparatus of this invention is capable of implementing high-precision scribing while following crown or other profile changes in the strip being worked with high yield.

DESCRIPTION OF THE PREFERRED EMBODIMENTS

Now preferred embodiments of this invention will be described by reference to the accompanying drawings.

Figure 1:
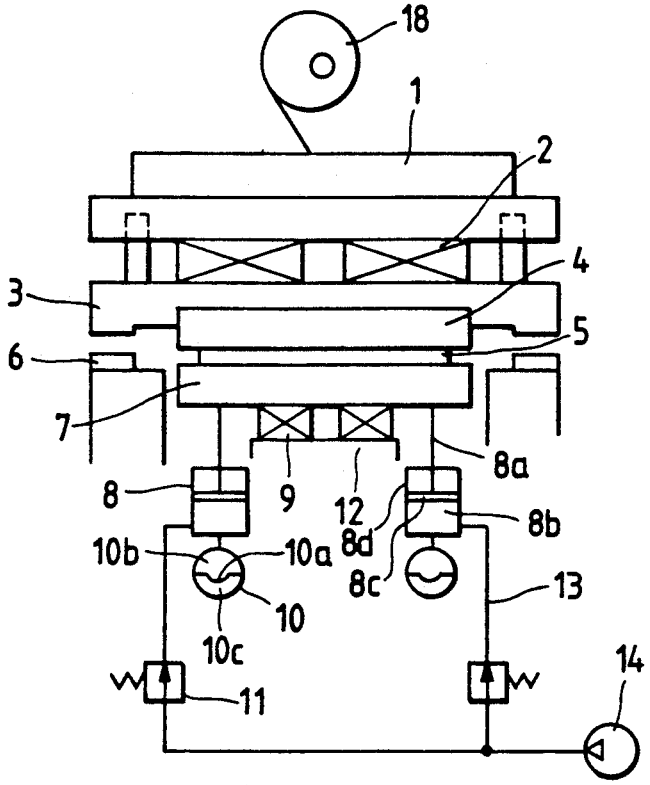
FIG. 1 is a schematic front view of a strip scribing apparatus according to this invention.
Figure 2:
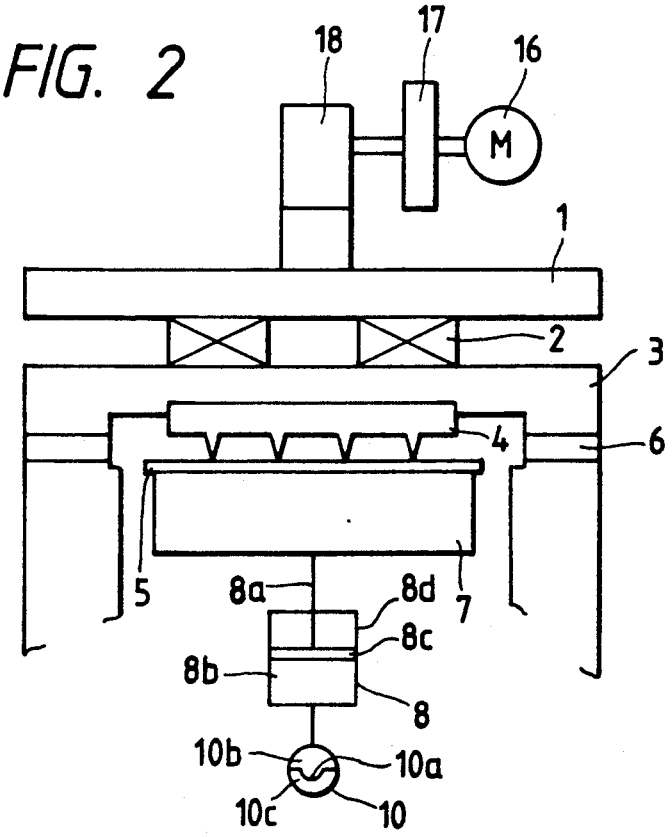
FIG. 2 is a side elvation of the strip scribing apparatus shown in FIG. 1.

FIG. 1 schematically shows an apparatus for scribing grain-oriented electrical steel strip that embodies the principle of this invention. Reference numeral 1 designates a slide, 2 a buffer, 3 a movable top die, 4 a scribing tool, 5 a grain-oriented electrical steel strip, 6 a stopper, 7 a fixed bottom die, 8 a hydraulic cylinder, 9 an auxiliary spring, 10 an accumulator (a pressurized liquid container), 11 a pressure regulating valve, and 12 a bolster.

The scribing tool 4 shown here is of the type that scribes equally spaced linear impressions across the width of the strip 5. The scribing tool 4 is replaceably mounted on the top die 3. The scribing tool 4 may be of various types forming continuous, discontinuous, straight, curbed and other impressions. The scribing tool 4 must be made of a material that has enough hardness, strength, toughness and wear resistance to impart plastic deformation to the strip, such as cemented carbide. The scribing tool 4 shown in the figure is attached to the top die 3. Basically, however, there is no limitation as to the position of the scribing tool 4, which may, therefore, be attached to the bottom die 7 or to both of the top and bottom dies 3 and 7. Otherwise, a die itself may be formed as a scribing tool. The top die 3 is attached to the slide 1 with the buffer 2 interposed therebetween. A disk spring or other similar devices may be used as the buffer 2. To protect the elevating mechanism, the reaction force of the buffer 2 is kept below the screwdown load. The slide 1 is connected to a crank mechanism 18.

Connected to the piston rod 8*a*, the bottom die 7 is supported by the hdyraulic cylinder 8. Directly below the hydraulic cylinder 8 is disposed an accumulator 10 that serves as a pressure-retaining mechanism, with the back pressure side 8*b* of the hydraulic cylinder 8 directly communicating with the liquid chamber 10*b* of the accumulator 10. The back pressure side 8*b* of the hydraulic cylinder also communicates with the pressure regulating valve 11 through piping 13. The pressure is set at such a level that the applied load exceeds the deformation resistance of the strip 5.

The accumulator 10 primarily works in response to the pressure wave spreading through the hydraulic fluid, rather than the flow of the hydraulic fluid itself. While serving as a route for the propagation of the pressure wave, the liquid chamber 10*b* causes the diapragm to change its shape according to changes in the pressure. Thus, the accumulator 10 permits keeping a constant pressure by quickly responding to changes. Accordingly, the distance between the piston 8*c* of the hydraulic cylinder 8 and the diaphragm 10*a* is such that the time the pressure wave spreading through the hydraulic fluid takes in traveling from the piston 8*c* to the diaphragm 10*a* of the accumulator 10 is kept shorter than the time the teeth of the scribing apparatus 4 takes in reaching the desired depth. when scribing 400 times in a minute with a scribing depth of 25 $\mu$m, for example, the time the teeth of the scribing apparatus 4 takes in biting the strip 5 is 0.0001 second. On the other hand, the propagation speed of the pressure wave in the hydraulic fluid is approximately 1400 m/sec. To make the propagation time of the pressure wave shorter than 0.0001 second, therefore, the distance between the piston 8*c* of the hydraulic cylinder 8 and the diaphragm 10*a* of the accumulator 10 must be 200 mm or under. Direct connection of an independent accumulator 10 to each hdyraulic cylinder 8 eliminates excess piping, with a resulting shortening of the distance between the piston 8*c* of the hydraulic cylinder 8 and the diaphragm 10*a*. Accumulators in general are commonly used for the make-up of hydraulic energy, absorption of surge pressure, shock absorbing, and make-up for hydraulic fluid leakage. The function of the accumulator used in the scribing apparatus being discussed, by comparison, differs entirely from those of the conventional accumulators. Repeating high-speed reciprocation, the hydraulic cylinder 8 requires special seals and packing. For example, a long-life packing allowing some leakage may be used. The leakage of the hydraulic fluid from between the piston 8*c* and the cylinder tube 8*d* must not exceed the level at which the hydraulic cylinder 8 can practically maintain large enough deformation resisting reaction force to correspond to the strain that depends upon the scribing depth in the strip. When this type of packing is used, a pump 14 must be continuously operated. The accumulator 10 is of an ordinary type whose insdie is partitioned into a liquid chamber 10*b* and a gas chamber 10*c* by a diaphragm 10*a* of rubber of other elastic material. The liquid chamber 10*b* communicates with the back pressure side 8*b* of the hydraulic cylinder 8, whereby the pressure of the hydraulic liquid is balanced with the pressure of the nitrogen gas in the gas chamber 10*c*. The bottom die 7 is attached to the bolster 12 with the auxiliary spring 9 interposed therebetween. The auxiliary spring 9 is designed to create a reaction force equivalent to the weight of the bottom die 7 when the scribing tool 4 reaches the bottom dead center. The strip 5 is positioned between the scribing tool 4 and the bottom die 7.

The following paragraphs describe the operation of the strip scribing apparatus just described.

The slide 1 is connected to a motor 16 through a flywheel 17 and the crank mechanism 18. The crank mechanism 18 changes the rotational motion of the flywheel 17 that continues to rotate at a constant speed into a high-speed updown motion of the slide 1. The bottom die 7 and the stopper 6 are positioned slightly higher than the bottom dead center of the scribing tool 4. But the stopper 6 is positioned lower than the bottom die 7 so that the scribing tool 4 comes in contact with the strip 5 first. The motion of the individual members in one cycle is as follows. As the slide 1 descends from the top dead center, the scribing tool 4 comes in contact with the strip 5 to form linear impressions thereon. The intermittent feeder (not shown) discontinues the feed of the strip 5 from the time at which the scribing tool 4 comes in contact therewith to the time at which the scribing tool 4 clears the strip 5. The feed is made until the scribing tool 4 that has cleared the strip 5 and passed the top dead center comes in contact therewith again.

Figure 3:
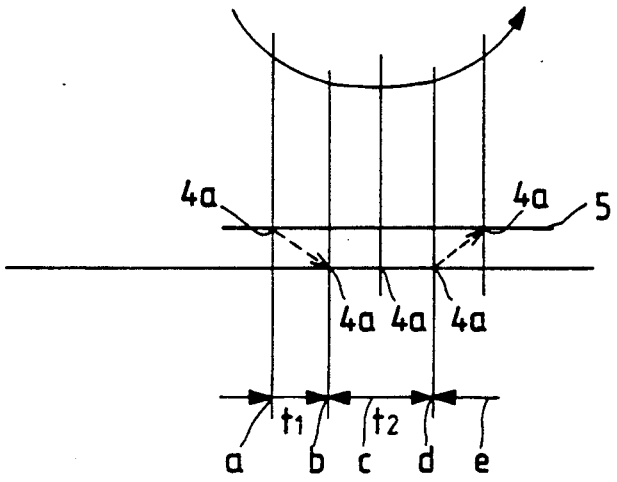
FIG. 3 schematically illustrates a path drawn by the tip of a scribing tool.

FIG. 3 schematically shows paths described by the tip of the scribing tool. The upper circular path shows how the absolute height of the tip 4*a* of the scribing tool changes with time. The lower path shows how the height of the tip 4*a* of the scribing tool changes in relation to the strip 5. Of the two lines horizontally crossing the paths, the upper one shows the surface of the strip while the lower one shows the bottom of the linear impression. The level difference between the two lines shows the depth of the linear impression. Therefore, the lower path shows how the penetrating depth of the scribing tool in the strip changes with time. The deformation resistance corresponding to the deflection of the strip 5 caused by scribing increases as the scribing tool 4 descends during a period $t_1$ between point a at which the tip 4*a* of the scribing tool 4 comes in contact with the strip 5 and point b. The bottom dead center c of the path being discussed is slightly above that of a true circle because the scribing tool 4 begins to run away upward at point b where the deformation resistance exceeds the reaction force set by the buffer 2. Point e is where the tip 4*a* of the scribing tool 4 comes out of contact with the surface of the strip 5. By virtue of this cushioning effect, the tip 4*a* of the scribing tool stays at the bottom of the linear impression for a certain time between b and d as indicated by the lower path. This facilitates maintaining the scribing depth within the desired tolerance. The breaking-in time $t_2$ in FIG. 3 shows a period during which the effect just described is dominant.

As the scribing tool 4 descends, the bottom die 7 is pressed down together with the strip 5. The hydraulic cylinder 8 too is pressed down over the same distance. When the piston of the hydraulic cylinder 8 begins to descend, as much hydraulic liquid as is equal to the product of the traveling distance multiplied by the cross-sectional area of the cylinder is fed to the accumulator 10. Because the accumulator 10 is adequately large to hold the fluid thus supplied, an increase in pressure, though measured, does not exert influence on the pressure regulating valve 11. Accordingly, the variation in the fluid level is absorbed by the elastic deformation of the diaphragm 10*a* that balances the pressure of the hydraulic liquid with that of nitrogen gas. Consequently, the pressure in the accumulator 10 remains at the preset level.

When the scribing tool 4 begins to ascend from the bottom dead center, the pressure of the accumulator 10 pushes up the piston of the hydraulic cylinder 8 until the stroke end thereof is reached. Pushed back upward by the reaction force of the auxiliary spring 9 corresponding to the deflection resulting from the downward travel of the bottom die 7, the bottom die 7 quickly returns to the original position. By repeating this cycle, the strip 5 can be scribed with high accuracy and speed.

The operating speed is limited by the performance of the pressing means or the intermittent feeder. The maximum speed of the punch presses of 10 to 20 tons capacity ranges between 2500 and 3000 strokes per minute. On the other hand, the performance of the high-speed intermittent feeders depends on the capability of their indexing mechanism at their heart. Though the highest speed ever recorded is 6000 indexing per minute, commercially available feeders have a wide variety of speed and maximum feed distance. For example, the highest speed of 2000 strokes per minute (with a feed distance of 70 mm) and the longest feed distance of 400 mm (with a speed of 500 strokes per minute) are available. Generally, the larger the number of strokes per minute, the shorter that feed distance and the smaller the imposed load. The number of strokes can be decreased by increasing the feed distance or the applied load. Optimum combinations to suit the desired productivity and available fund for capital investment can be chosen out of many combinations.

Where an accuracy of under 10 μm, which might be impaired by the crown of grain-oriented electrical steel strip, is desired, the accuracy of the scribing depth can be secured by taking advantage of the deflection of the bottom die. This can be achieved by choosing such cylinder supporting point, load and bottom die design as will permit the bottom die to bend in such a manner that the top surface of the strip becomes substantially flat when the scribing tool reaches the bottom dead center in accordance with the amount of strip crown. Because the amount of crown is substantially uniform throughout a coil and scarcely exceeds 10 μm, high-level accuracy control can be achieved through the adjustment of load distribution or other methods if the bottom die is held at the desired level. If there is no need to care about the surface properties of the under side of the strip, the bottom die may be divided widthwise. This results in substantial size reduction since the cylinder load can be held uniform and the bottom die level need not be very high.

The strip profile need not be exactly flat so long as proper feed can be insured. In principle, there is no limit on the thickness of workable strip. Practically, however, strip heavier than 3.2 mm in thickness will not be workable because the controllability of scribing depth to compensate for crown and other changes in strip profile decreases with an increase in strip rigidily.

EXAMPLE 1

Relatively simple linear impressions were formed on grain-oriented electrical steel strip.

Figure 4:
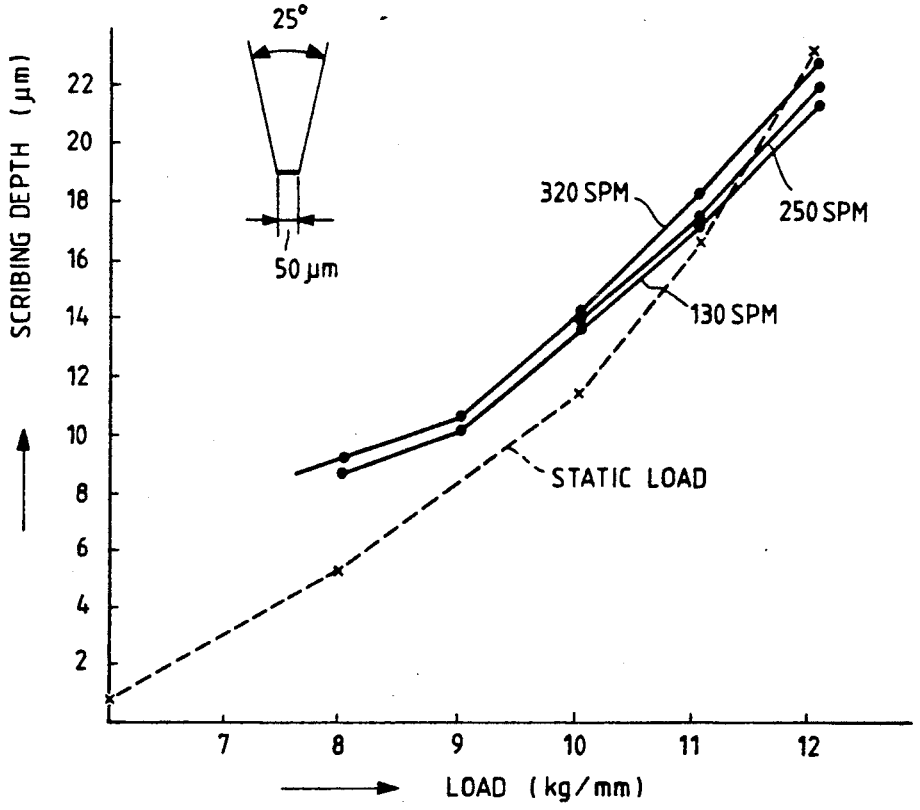
FIG. 4 graphically shows the relationship between the scribing depth and the fixed bottom die supporting pressure with a strip scribing apparatus of this invention.

Specimens of grain-oriented electrical steel strip 0.23 mm thick and 140 mm wide were scribed to a depth of about 10 μm at intervals of 5 mm. The presses used had a maximum loading capacity of 20 tons, with a rated maximum speed of 320, 250 and 130 strokes per minute. Because the die had four teeth, the strip was fed at a rate of 20 mm per stroke. The relationship between the scribing depth and deformation resistance was grasped in advance using a lowspeed press. The pressure of the accumulator was set by means of the pressure regulating valve, with an aim taken at the reaction force corresponding to the deformation resistance. FIG. 4 shows the resultant scribing depths. A definite interrelationship was observed between the preset pressure of the accumulator and the scribing depth. Though the results differed from the measurements with the low-speed press, the scribing depth varied little with different operating speeds.

Figure 5:
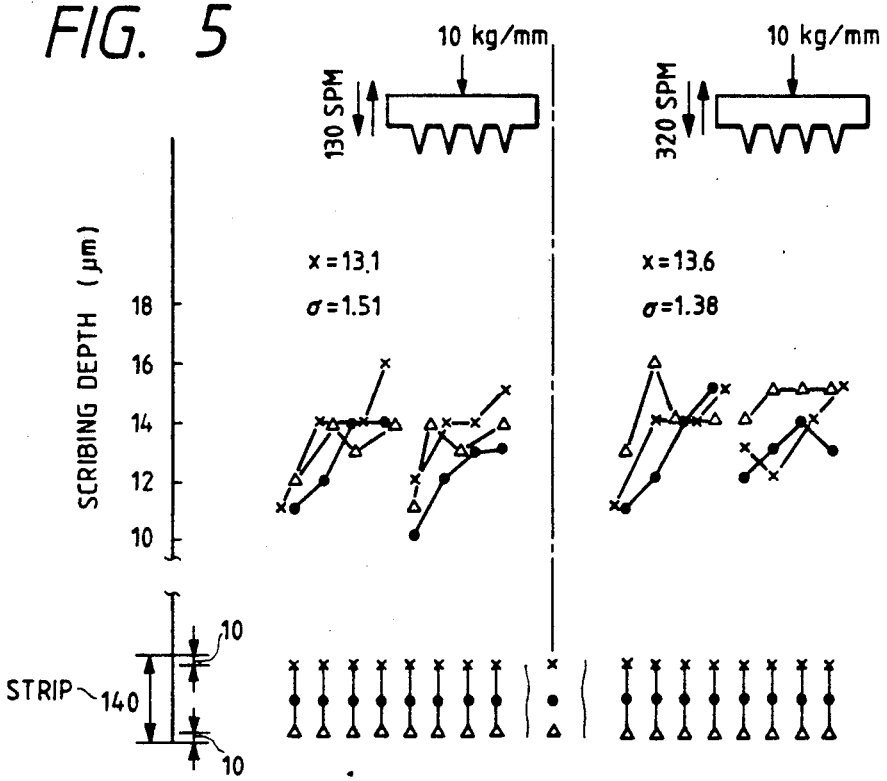
FIG. 5 graphically shows the accuracy of the scribing depth obtained with a strip scribing apparatus of this invention.

FIG. 5 shows how the linear impressions vary in the longitudinal direction of the strip. The depth of eight impressions made by the four teeth in two strokes was measured at three points across the strip width. The measured depths averaged 12.75 μm, scattering within the limit of ±2.5 μm. The scattering in the longitudinal direction was more pronounced than that across the strip width. The longitudinal errors are ascribable to the accuracy with which the scribing tool is machined and the dies assembled. On the other hand, the widthwise errors can be corrected by adjusting the balance of the accumulators if the assembling accuracy remains within an acceptable limit.

The tool operated with a stroke of 15 mm required 0.0018 second to reach the bottom dead center after coming in contact with the strip. This time was too short to attain even with a servo valve.

EXAMPLE 2

The condition of wider strip was examined using the same tool as that used in Example 1.

Specimens of grain-oriented electrical steel strip 0.23 mm thick and 1000 mm wide were scribed with twenty-eight teeth to a depth approximately 10 μm at intervals of 5 mm. The bottom die was 150 mm long in the direction of feed. The strip had a crown. The thickness deviation was not more than 1 μm in the 400 mm wide central area and 4 μm in edges. The bottom die was supported with four cylinders. While the inner two cylinders supported points 200 mm away from the center, the outer two supported both edges. The press used in the experiment had a maximum loading capacity of 300 tons and a maximum speed of 320 strokes per minute. As there were twenty-eight teeth, the feed rate was set at 140 mm per stroke. The relationship between the scribing depth and deformation resistance was determined in advance using a low-speed press. The pressure of the accumulator was set by means of the pressure regulating valve, with an aim taken at the reaction force corresponding to the deformation resistance.

Figure 6:
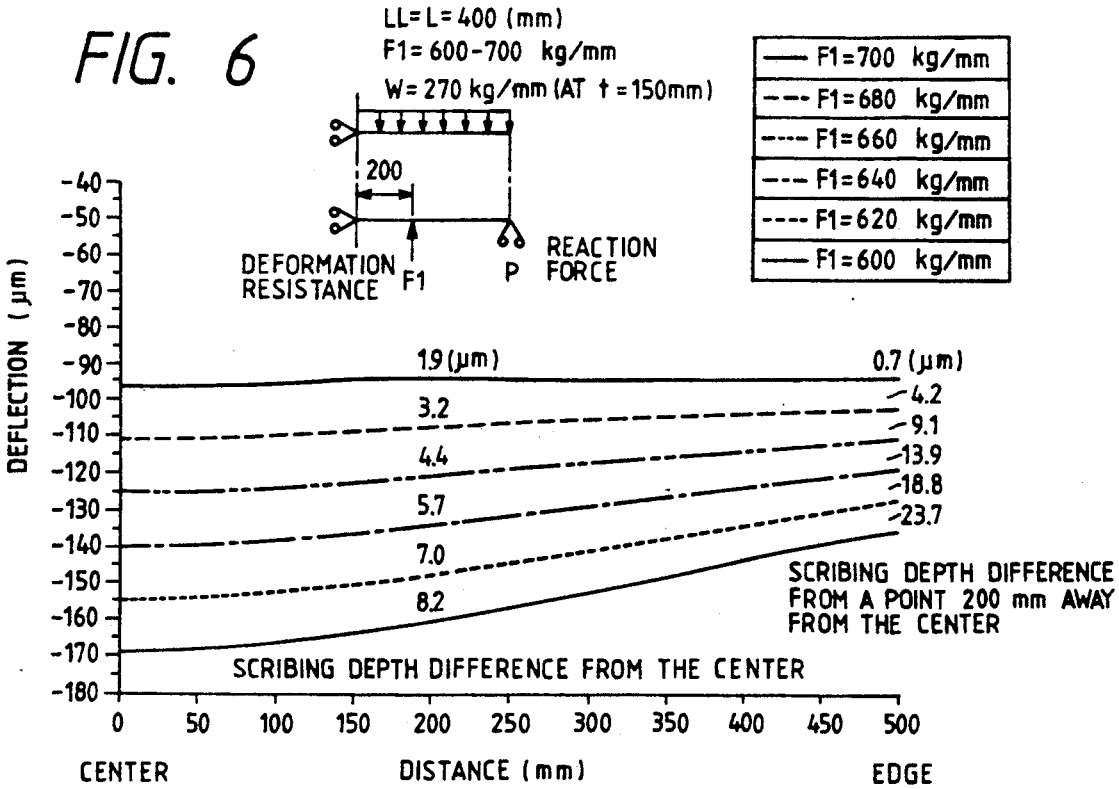
FIG. 6A graphically shows how the deflection of the bottom die resulting when scribing 1000 mm wide strip is controlled by adjusting the load on the cylinder connected thereto.
FIG. 6B is a schematic load diagram for a scribing depth difference from a point 200 mm away from the center.

FIG. 6A shows a depth profile of linear impressions scribed across the width of a strip having a crown of approximately 10 μm. FIG. 6B is a schematic load diagram for a scribing depth difference from a point 200 mm away from the center. In the figure, the depth of linear scribing at the center of the strip width agrees with the bend of the bottom die during working even when the reaction distribution between parameters F1 and P (which are the thrust or reaction per unit thickness of the strip) is varied little by little. Obviously, the depth profile of linear scribing can be changed by varying the bending of the bottom die. The bending characteristic of the bottom die can be approximated to that of rolls during rolling by adjusting the distribution of second moment of area or reaction across the width of the strip. With a bottom die whose height is 400 mm throughout the entire width thereof (LL=L=400 mm), the crown in the strip is offset by the bend of the bottom die when the thrust F1 of the cylinders in the middle is set to apply a load of 700 kg/mm. Then, the top surface of the strip on the bottom die becomes substantially flat, whereby the depth of the linear impressions scribed across the width of the strip becomes uniform.

EXAMPLE 3

A broad tool analogous to the one used in Example 2 was incorporated in a strip mill. The scribing interval was reduced from 5 mm to 3 mm. Specimens of grain-oriented electrical steel strip 0.3 mm thick and 1000 mm wide were scribed to a depth of 5 μm.

With a press having a maximum loading capacity of 300 tons and a maximum speed of 500 strokes per minute and a scribing interval of 5 mm, a maximum of nineteen teeth proved to be affordable, giving an allowance of approximately 10 percent for the maximum load, at a line speed of up to 47.5 m per minute because of the load limitations.

To attain equal productivity with one press while reducing the scribing interval to 3 mm, the number of strokes must be made approximately 1.7 (5/3) times greater if the tooth pitch of 3 mm is left unchanged. When scribing the strip to the same depth at reduced intervals, on the other hand, a greater reaction force resulting from the interaction of the plastic deformation of adjoining teeth must be overcome. When the scribing interval is reduced from 5 mm to 3 mm, for example, the reaction force increases approximately 20 percent as shown in Table 1. To meet these requirements, the press must have a higher responding speed and a greater loading capacity. With ordinary presses, however, the loading capacity drops with the working speed is increased. When the working speed is increased to 800 strokes per minute, for example, the applicable load drops to 125 tons or less than half the level with the operation at 500 strokes per minute. As such, it is practically impossible to achieve equal productivity at higher speed. It may be technically possible to design a special-purpose press to meet these requirements. But the design and the testing of a prototype will be both time-consuming and costly.

Table 1 shows the relationship between the scribing intervals and the reaction force to scribing. Table 2 shows the results of case studies on the attainment of 3 mm wide scribing intervals.

TABLE 1

| | | | |
|---|---|---|---|
| Scribing Interval (mm) | 6 | 5 | 3 |
| Linear Load (kg/mm) | 13 | 14 | 17 |

TABLE 2

| | | Case | | | |
|---|---|---|---|---|---|
| | | Standard | 1 | 2 | 3 |
| | | Layout | | | |
| | | Single | Single | Tandem | Tandem |
| | | Teeth Pitch (mm) | | | |
| | | 5 | 3 | 3 | 6 |
| P | Scribing Interval (mm) | 5 | 3 | 3 | 3[1] |
| N | No. of Press | 1 | 1 | 2 | 2 |
| Z | No. of Teeth | 19 | 15 | 15 | 20 |
| V | Line Speed[2] (mpm) | 47.5 | 22.5 | 45 | 60 |

[1]Two scribing apparatus are displaced by half an interval.
[2]$V = P \times N \times Z \times 500/1000$ But the problems mentioned before can be solved with a plurality of standard presses arranged in appropriate layouts. Two layouts are preferable. In one layout, two presses each carrying a scribing tool whose teeth are spaced at intervals of 3 mm are placed continuously, one ahead of the other, in the direction of strip travel. In the other layout, the teeth interval of the scribing tool is doubled to 6 mm. Then two presses are disposed continuously, one ahead of the other with the scribing intervals thereof displaced by half an interval, in the direction of strip travel. In the former, an apparent increase in the scribing reaction force reduces the number of teeth. Thus the highest scribing speed attainable with two presses in 45 mpm (Case 2 in Table 2). In the latter, the smaller reaction force permits providing more teeth. Therefore, the highest scribing speed attainable with two presses is 60 mpm (Case 3 in Table 2). The line speed was higher than that with a scribing interval of 5 mm (Standard Case in Table 2).

Figure 7:
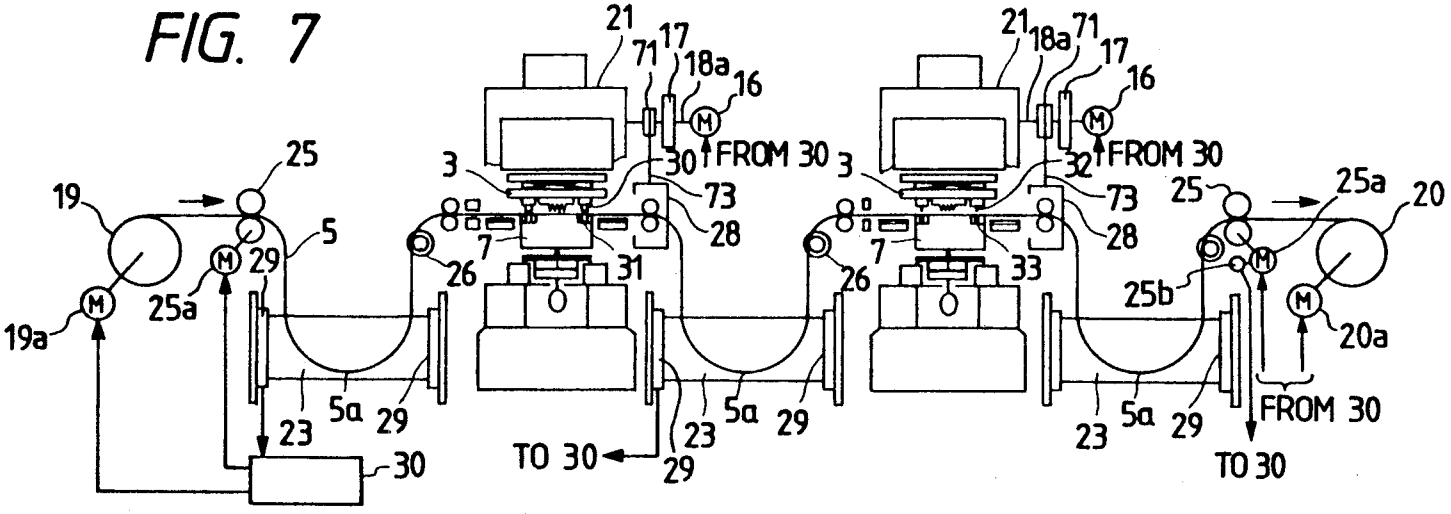
FIG. 7 shows a layout of a continuous strip mill in which a strip scribing apparatus of this invention and an intermittent feeder are disposed in tandem.

FIG. 7 shows an example of a tandem layout in which two scribing apparatus are arranged continuously, one ahead of the other, in the direction of strip travel. A pay-off reel 19 and take-up reel 20 are respectively provided on the entry side and the exit side of the scribing apparatus. A looping pit 23 is provided between the pay-off reel 19 and the scribing apparatus 21 and between the scribing apparatus 21 and the take-up reel 20. Forming a loop 5*a* and a strip 5, the looping pit 23 serves as a buffer to adjust the sagging of the strip the arises when the continuously supplied strip is intermittently fed into the scribing apparatus. Feed rolls 25 are provided on both the entry and exit sides of the scribing apparatus. The feed rolls 25 continuously feed the strip 5 into the scribing apparatus and continuously takes out the same strip 5 therefrom. A phototube 29, which determines the level of the lower end of the loop 5*a* by sensing the interruption of light, is provided on a side wall of each looping pit 23. The right amount of looping is chosen so that the thrashing of the intermittently fed strip 5 does not affect the gripping force of the intermittent feeder. The amount of looping is varied with the thickness and travel speed of the strip. A guide roll 26 to guide the strip 5 along the travel line is provided on the exit side of each looping pit 23. An intermittent feeder 28 is interposed between the exit end of each scribing apparatus 21 and the looping pit 23. Though disposed on the exit side of the scribing apparatus 21, the intermittent feeder 28 may be provided either on the entry side thereof or on both the entry and exit sides depending on the thickness of the strip and other factors affecting the travel thereof. Usually, the intermittent feeder is provided either on the entry side or on the exit side. It is provided on the exit side when the strip is thin, and on both sides when the line speed is very high.

A control unit 30 adjusts the a drive motor 19*a* for the pay-off reel 19 and a drive motor 20*a* for the take-up reel 20 to the predetermined line speed of the scribing apparatus. The control unit 30 also adjust a drive motor 25*a* for the feed roll 25 and a crank drive motor 16 for the scribing apparatus 21 to the predetermined line speed. As such, scribing is performed in keeping pace with the line speed. A tachometer generator 25*b* attached to the drive motor 25*a* for the feed roll 25 measures the line speed, which is, in turn, fed back to the control unit 30.

Figure 8:
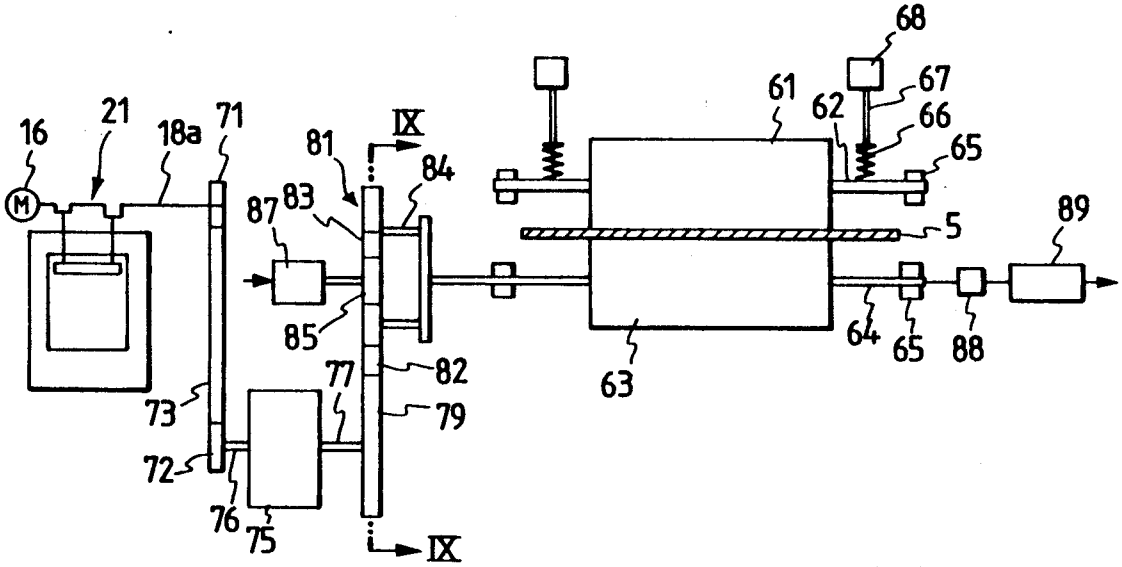
FIG. 8 schematically shows an intermittent strip feeder.
Figure 9:
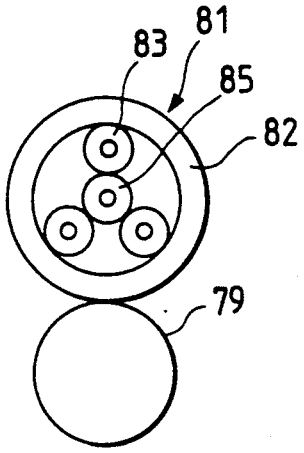
FIG. 9 is a cross-sectional view taken along the line IX–IX in FIG. 8.

As shown in FIG. 7, the crank shaft 18*a* of the scribing apparatus 21 and the pinch roll of the intermittent feeder are interlocked to synchronize the scribing action with the intermittent feed of the strip. FIG. 8 schematically shows the intermittent strip feeder. Pinch rolls 61 and 63 are rotatably supported by bearings 65. A coil spring 66 presses the upper pinch roll 61 against the lower pinch roll 63 through a roll shaft 62. The coil spring 66 is pressed by threaded shaft 67 which is, in turn, moved up and down by a step motor 68 to adjust the amount of deflection. By the adjustment of deflection, the force with which the rolls 61 and 63 grip the strip 5 is controlled. The lower pinch roll 63 is driven in synchronism with the crank mechanism 18 of the scribing apparatus 18 as described above. A pulley 71 is fastened to the crank shaft 18*a* of the scribing apparatus 21, whereas a pulley 72 is fastened to the input shaft 76 of the intermittent strip feeder 75. The pulley 72 and the pulley 71 on the crank shaft 18*a* are interlocked by means of a timing belt 73. The intermittent strip feeder 75 includes an intermittentduty geared cam (not shown), whereby the continuous rotation of the input shaft 76 is output as the intermittent rotation of the output shaft 77. To the output shaft 77 is fastened a drive gear 79, which is meshed with a ring gear 82 on a differential gear train 81. As shown in FIG. 9, three planet gears 83 connected by arms 84 mesh with the internal teeth of the ring gear 82. The planet gears 83 mesh with a sun gear 85 that is driven by a variable-speed motor 87. The arms 84 of the differential gear train 81 are connected to the roll shaft 64 of the lower pinch roll 63. To the roll shaft 64 is attached a tachometer generator 88, and the rotating speed of the roll measured thereby is fed back to the variable-speed motor 87 through a control unit 89. When the rotating speed of the variable-speed motor 87 changes, the rotating speed of the arms 84 of the differential gear train 81 changes. Therefore, the feed rate of the strip 5 can be controlled by adjusting the rotating speed of the variable-speed motor 87.

The scribing intervals of two or more scribing apparatus can be adjusted by controlling the operating timing thereof or by use of conventional positioning means.

Figure 10:
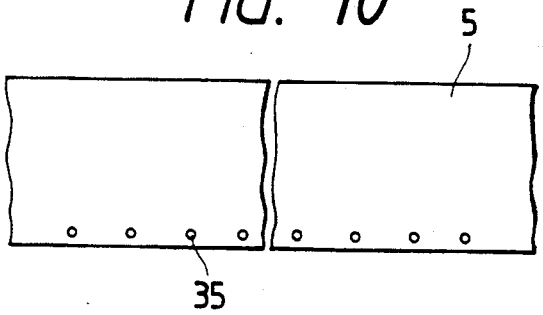
FIG. 10 is a plan view of a steel strip perforated with pilot holes for positioning.
Figure 11:
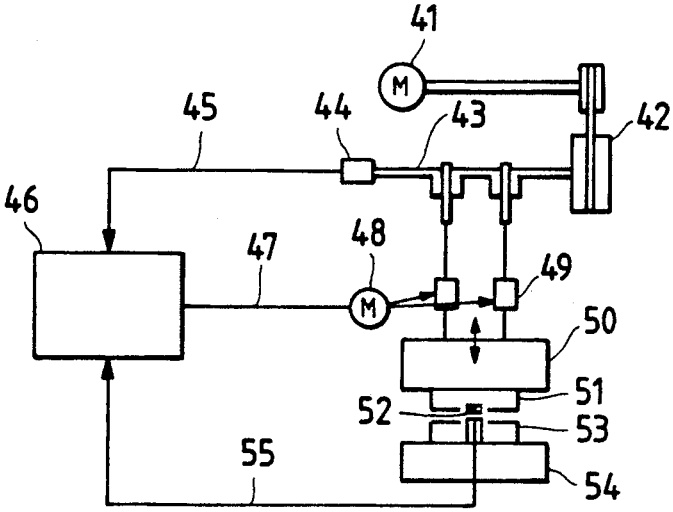
FIG. 11 PRIOR ART
FIG. 11 shows the construction of a conventional high-speed precision press equipped with a bottom dead center control mechanism.

For example, a piercing punch 30 may be provided on the top die 3 of the front scribing apparatus 21 and a hole die 31 on the bottom die 7 thereof, as shown in FIG. 7. The piercing punch 30 makes pilot holes 35 at given intervals at an end of the strip 5 as shown in FIG. 10. A pilot pin 32 and a pin guide 33 are provided on the top die 3 and the bottom die 7 of the rear scribing apparatus 21. Then, the rear scribing apparatus 21 keeps the strip 5 in the desired position by passing the pilot pin 31 through a pilot hole 35 in the strip 5 into the pin guide 33. This permits maintaining a steadily spaced scribing operation for a long time.

The layout just described contains two scribing apparatus. Theoretically, however, three or more scribing apparatus can be combined too, though space, maintainability and other limitations practically limit number of installations.

Even many different types of scribing patterns can be achieved by varying the scribing intervals. High-speed economical scribing operation can be performed using conventional presses. Even on the narrower side involving various equipment limitations, as high an accuracy as is equivalent to that of the feeder (0.025 mm maximum even at such a high speed as 2000 strokes per minute) and as high a speed as in equivalent to the number of strokes attained by a single press or feeder are attainable.

When operated continuously over a long period, the scribing apparatus of this invention may undergo various changes. For example, changes in the inertia force of the reciprocating segment will change the scribing speed. Thermal changes in machine parts will cause various displacement. Undesirable backlash may occur in the slide drive and other mechanical parts. All such changes might affect the accuracy of the product. But a compact hydraulic system supporting the bottom die permits eliminating the influence of such unfavorable changes without adjusting the press. Maintaining an appropriate hydraulic liquid pressure, the hydraulic system permits the apparatus to maintain the desired scribing accuracy by automatically following various mechanical and thermal changes and strip crown.

In the embodiment described herein, the movable top die and fixed bottom die are made of metal. But the two dies may be made of ceramics and disposed not vertically but horizontally. Both of the two dies may be of the movable type, too.

By replacing the bottom die supporting mechanism with a hydraulic system of the type described before or other similar appropriate device, an existing common scribing apparatus can be changed into a high-precision apparatus without modifying the drive unit of the mechanical press thereof.

We claim:

1. An apparatus for scribing grain-oriented electrical steel strip which comprises:

a movable die;

a drive unit to reciprocate the movable die;

a fixed die positioned opposite to and within the stroke of the movable die;

a scribing tool having linear teeth that is attached to at least either of the movable and fixed dies, the scribing tool forming linear impressions on strip to the desired depth held either between a die and a scribing tool or between two scribing tools;

a plurality of cylinders each having a piston and piston rod with the piston rods thereof supportingly connected to the fixed die, each cylinder having a back pressure side which increases in pressure by movement of said piston in each cylinder as a result of the scribing tool pressing against said strip; and an accumulator individually connected to the back pressure side of each cylinder, the accumulator divided into two chambers by a diaphragm, one of the chambers filled with a hydraulic fluid, the hydraulic fluid chamber communicating directly with the back pressure side of the cylinder with the piston of the cylinder and the diaphragm of the accumulator spaced apart from each other by a distance by which the time the pressure wave spreading throughout the hydraulic fluid takes in traveling from the piston to the diaphragm of the accumulator is kept shorter than the time the teeth of the scribing apparatus takes in reaching the desired depth.

2. An apparatus for scribing grain-oriented electrical steel strip according to claim 1, in which the cylinder has a gap between the cylinder tube and the piston thereof that permits such a quantity of the hydraulic fluid to leak therethrough as is large enough to practically maintain said deformation resisting reaction force of the strip, and a pressure regulating valve connected to the back pressure side of the cylinder, with the pressure thereof set to the level corresponding to the deformation resisting reaction force of the strip and a pump connected to the back pressure side of the cylinder through the pressure regulating valve to constantly make up for the lost hydraulic fluid are provided.

3. An apparatus for scribing grain-oriented electrical steel strip according to claim 1, in which the movable die reciprocating drive unit comprises a motor, a flywheel rotated by the motor, and a crank mechanism driven by the flywheel and connected to the movable die.

4. An apparatus for scribing grain-oriented electrical steel strip according to claim 1, in which a die and a scribing tool are incorporated into a single assembly.

5. An apparatus for scribing grain-oriented electrical steel strip according to claim 1, in which the movable die reciprocating drive unit contains a buffer, the reaction force of the buffer being set at a level the deformation reaction corresponding to the deflection created while the scribing tool attached to the movable die travels from the point of contact with the strip to the bottom dead center of a path described thereby.

6. An apparatus for scribing grain-oriented electrical steel strip according to claim 1, in which the fixed die is divided into several segments either across or along the direction of strip travel, each of the divided segments being independently supported by a cylinder connected to an accumulator kept at the same pressure.

7. An apparatus for scribing grain-oriented electrical steel strip according to claim 1, in which the fixed die is supported by an auxiliary spring which is adapted to create a reaction force equivalent to the weight of the fixed die when the scribing tool reaches the bottom dead center of a path described thereby.

8. An apparatus for scribing grain-oriented electrical steel strip comprising a movable die, a drive unit to reciprocate the movable die, a fixed die positioned opposite to and within the stroke of the movable die, a scribing tool having linear teeth that is attached to at least either of the movable and fixed dies, the scribing tool forming linear impressions on strip to the desired depth held either between a die and a scribing tool or between two scribing tools, a plurality of cylinders each having a piston and piston rod with the piston rods thereof supportingly connected to the fixed die, each cylinder having a back pressure side which increases in pressure by movement of said piston in each cylinder as a result of the scribing tool pressing against said strip, and an accumulator individually connected to the back pressure side of each cylinder, the accumulator divided into two chambers by a diaphragm, one of the chambers filled with a hydraulic fluid, the hydraulic fluid chamber communicating directly with the back pressure side of the cylinder with the piston of the cylinder and the diaphragm of the accumulator spaced apart from each other by a distance by which the time the pressure wave spreading throughout the hydraulic fluid takes in traveling from the piston to the diaphragm of the accumulator is kept shorter than the time the teeth of the scribing apparatus takes in reaching the desired depth, which further comprises:

an intermittent feeder provided at least on one of the entry and exit sides of each scribing apparatus and interlocked to discontinue the feed of the strip while the scribing operation is being carried out and feed the strip foward a predetermined distance while the scribing operation is not carried out; and a looping pit provided on both the entry and exit sides of the scribing apparatus.

9. An apparatus for scribing grain-oriented electrical steel strip comprising a movable die, a drive unit to reciprocate the movable die, a fixed die positioned opposite to and within the stroke of the movable die, a scribing tool having linear teeth that is attached to at least either of the movable and fixed dies, the scribing tool forming linear impressions on strip to the desired depth held either between a die and a scribing tool or between two scribing tools, a plurality of cylinders each having a piston and piston rod with the piston rods thereof supportingly connected to the fixed die, each cylinder having a back pressure side which increases in pressure by movement of said piston in each cylinder as a result of the scribing tool pressing against said strip, and an accumulator individually connected to the back pressure side of each cylinder, the accumulator divided into two chambers by a diaphragm, one of the chambers filled with a hydraulic fluid, the hydraulic fluid chamber communicating directly with the back pressure side of the cylinder with the piston of the cylinder and the diaphragm of the accumulator spaced apart from each other by a distance by which the time the pressure wave spreading throughout the hydraulic fluid takes in traveling from the piston to the diaphragm of the accumulator is kept shorter than the time the teeth of the scribing apparatus takes in reaching the desired depth, which further comprises:

an intermittent feeder provided at least on one of the entry and exit sides of each scribing apparatus and interlocked to discontinue the feed of the strip while the scribing operation is being carried out and feed the strip forward a predetermined distance while the scribing operation is not carried out;

a looping pit provided on both the entry and exit sides of the scribing apparatus;

a punch attached to the movable die on the uppermost scribing apparatus, the punch being adapted to perforate pilot holes at given intervals along the edge of the strip; and pilot pins provided to the movable dies on the scribing apparatus positioned downstream of the uppermost scribing apparatus.

10. An apparatus for scribing grain-oriented electrical steel strip according to claim 9, in which two or more scribing apparatus are disposed, the scribing tool of each scribing apparatus having as many teeth as are spaced at intervals equal to the intervals at which the strip is to be scribed multiplied by the number of scribing apparatus disposed, with the operating intervals of contiguous scribing apparatus being shifted by said scribing intervals.

* * * * *